US005358217A

United States Patent [19]

Dach

[11] Patent Number: 5,358,217

[45] Date of Patent: Oct. 25, 1994

[54] LIFTING APPARATUS

[76] Inventor: Ernie Dach, #2, 52512 Range Road 214, Ardrossan, Alberta, Canada, T0B 0E0

[21] Appl. No.: 102,270

[22] Filed: Aug. 5, 1993

[51] Int. Cl.[5] ..... B66F 3/00

[52] U.S. Cl. ..... 254/2 R; 254/134

[58] Field of Search ..... 254/2 R, 2 B, 7 R, 7 B, 254/89 R, 89 H, 133, 134, 100; 269/17

[56] References Cited

U.S. PATENT DOCUMENTS

| | | | |
|---|---|---|---|
| 2,998,960 | 9/1961 | Smith | 254/2 R |
| 3,740,020 | 6/1973 | Arnes | 254/2 B |
| 4,066,243 | 1/1978 | Johnson | 254/133 R |
| 4,123,038 | 10/1978 | Meyers | 254/2 R |
| 4,491,452 | 1/1985 | Matovich | 254/89 R |
| 4,549,721 | 10/1985 | Stone . | |

*Primary Examiner*—Robert C. Watson
*Attorney, Agent, or Firm*—Anthony R. Lambert

[57] ABSTRACT

A lifting apparatus is described which includes a base with two spaced apart tubular members extending substantially vertically from the base. Two telescopic members are telescopically received in the tubular members. A transverse member is secured transversely between the telescopic members. A jack positioning seat is positioned on the base vertically aligned with the transverse member, such that a jack placed on the jack positioning seat engages the transverse member to telescopically raise telescopic members. A pair of parallel spaced support arms extend from the transverse member, each support arm has lifting points adapted for positioning under an object to be lifted. The base is adapted to maintain stability when a load is placed on the lifting points of the support arms. The telescopic members are locked in a selected position relative to the tubular members when the object being lifted is at the desired height.

13 Claims, 13 Drawing Sheets

LIFTING APPARATUS

BACKGROUND OF THE INVENTION

There are various lifting applications in which commercially available jacks are not suitable. One lifting application which serves as an example relates to the servicing of lawn and garden tractors. A large lawn and garden tractor can weigh as much as 1500 pounds. Care must be taken in jack placement when lifting a lawn and garden tractor in order to avoid damaging the tractor. If the jack engages the outer housing of the tractor, the outer housing is prone to bending. If the jack engages operating components, such as the differential, the differential is subject to cracking. Unfortunately, when the jacks are properly positioned to bear against reinforced areas of the frame they are in the way. It becomes difficult, if not impossible, to drop the deck of the lawn and garden tractor to gain access to belts, and other operating components. A further problem relating accessibility is the height to which the tractor must be lifted in order to permit a man on a creeper dolly to roll underneath the lawn and garden tractor and still have room to work. When a heavy lawn and garden tractor is lifted to a working height, a potential safety hazard is presented in the event of jack failure, or an accidental lateral impact upon the lawn and garden tractor. This stability problem is further exacerbated by the single point contact that the jack has with the object being lifted. There is always a danger of the jack slipping.

SUMMARY OF THE INVENTION

What is required is a lifting apparatus which addresses the shortcomings of prior art devices.

According to the present invention there is provided a lifting apparatus which includes a base with two spaced apart tubular members extending substantially vertically from the base. Two telescopic members are telescopically received in the tubular members. A transverse member is secured transversely between the telescopic members. A jack positioning seat is positioned on the base vertically aligned with the transverse member, such that a jack placed on the jack positioning seat engages the transverse member to telescopically raise telescopic members. A pair of parallel spaced support arms extend from the transverse member, each support arm has lifting points adapted for positioning under an object to be lifted. The base is adapted to maintain stability when a load is placed on the lifting points of the support arms. Means is provided for locking the telescopic members in a selected position relative to the tubular members when the object being lifted is at the desired height.

When the lifting apparatus, as described, is used the jack is positioned on the jack positioning seat, which is to the side and out of the way. When the lawn and garden tractor is elevated by the support arms, the base provides greater stability than is possible using a jack. Once raised to the desired position, the telescopic members are locked in position in relation to the tubular members; thereby providing protection against jack failure.

There are various ways of providing the requisite stability to the base. One way is to bolt the base to the floor. Another way is to have a heavy, broad platform type of base. It is preferred, however, the base be in the form of a frame having stabilizing legs that extend past the support arms thereby providing stability to the base when a load is placed on the lifting points of the support arms.

Although beneficial results may be obtained through the use of the lifting apparatus, as described, when a lawn and garden tractor is being lifted and the telescopic members are at their full height, there is potentially a problem with the telescopic members moving laterally under the load. When this happens the telescopic member does not easily telescope into the tubular members; as a binding occurs. Even more beneficial results may, therefore, be obtained by having stiffening support members which extend upwardly from the tubular members parallel to the telescopic members and on the same side of the telescopic members as the support arms. The stiffening support members provide lateral support to the telescopic members when a load is placed upon the support arms.

Although beneficial results may be obtained through the use of the lifting apparatus, as described, when a lawn and garden tractor is being lifted there is also a strain placed upon the support arms. Even more beneficial results may, therefore, be obtained by having the support arms generally "L" shaped with a vertical portion depending from the transverse member and a horizontal portion extending from the vertical portion. With this "L" shaped configuration the lifting points are on the horizontal portions. A roller is positioned between the vertical portions of the support arms and the tubular members. The presence of the rollers enables the vertical portions of the support arms to bear against the tubular members for lateral support when a load is placed upon the lifting points of the support arms.

Although beneficial results may be obtained through the use of the lifting apparatus, as described, the addition of a few other features adds to the versatility of the lifting apparatus. Even more beneficial results may, therefore, be obtained by having the support arms laterally movable along the transverse member, whereby relative spacing the support arms is adjusted. Even more beneficial results may, similarly, be obtained by having the horizontal portion of the support arms telescopically extendable.

Although beneficial results may be obtained through the use of the lifting apparatus, as described, the outer housing of the tractor sometimes prevents the lifting points on the horizontal portion of the arms from engaging reinforced areas of the frame. Even more beneficial results may, therefore, be obtained by having the lifting points vertically adjustable. In this manner the lifting points can "reach around" more fragile areas of the outer housing to engage reinforced areas of the frame.

Although beneficial results may be obtained through the use of the lifting apparatus, as described, sometimes the positioning of components makes it impossible to engage reinforced areas of the frame using parallel arms. Even more beneficial results may, therefore, be obtained by having the lifting points horizontally adjustable. In this manner the lifting points can "reach around" components to engage reinforced areas of the free.

There are various means available for locking the telescopic members in a selected position relative to the tubular members. The preferred means includes a plurality of apertures in the telescopic members one of which is aligned with one aperture in the stiffening support member. A pin is inserted through the aligned apertures thereby locking the telescopic members in a selected position relative to the tubular members.

BRIEF DESCRIPTION OF THE DRAWINGS

These and other features of the invention will become more apparent from the following description in which reference is made to the aped drawings, wherein:

FIG. 5 is a top plan view of the lifting apparatus illustrated in. FIG. 1.

DETAILED DESCRIPTION OF THE PREFERRED EMBODIMENT

Figure 1:
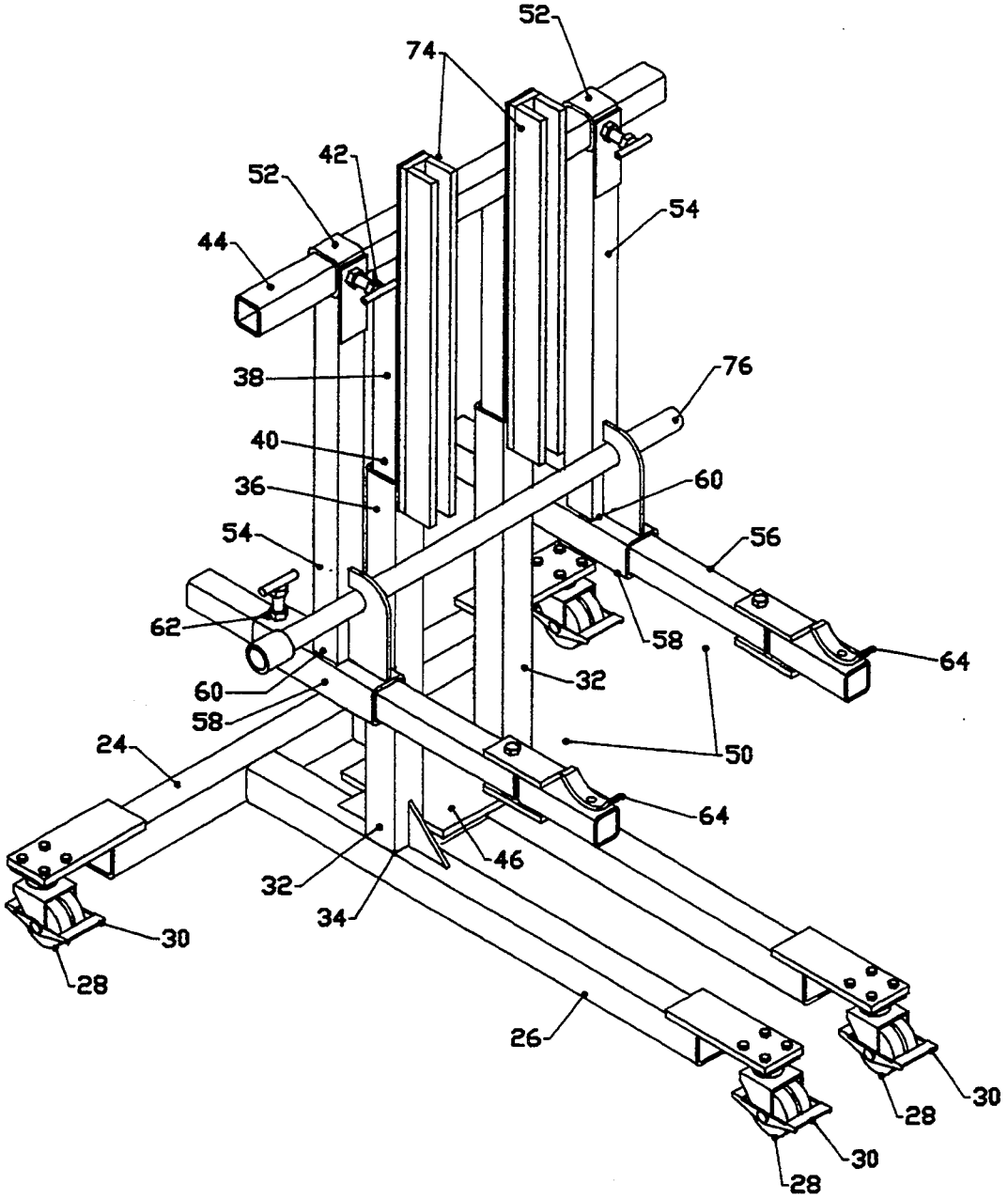
FIG. 1 is a perspective view of a first embodiment of a lifting apparatus constructed in accordance with the teachings of the present invention.

The preferred embodiment, lifting apparatus generally identified by reference numerals 20 and 22, will now be described with reference to FIGS. 1 through 13. FIGS. 1 through 6 illustrate a first embodiment 20. FIGS. 7 through 13 illustrate a second embodiment 22. First embodiment 20 and second embodiment 22 arrange the same basic components in alternative manners, as will hereinafter be further described.

Figure 2:
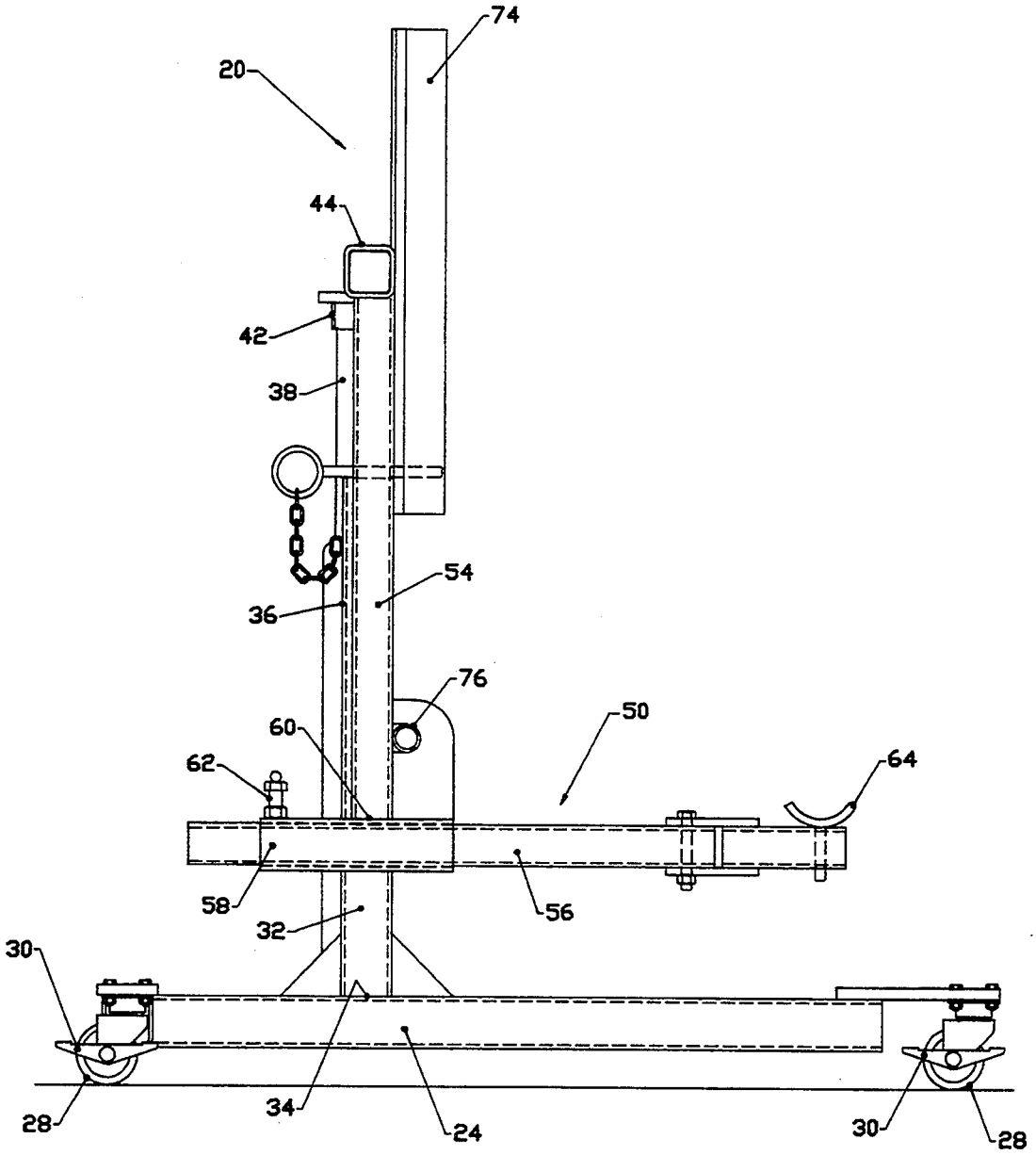
FIG. 2 is side elevation view of the lifting apparatus illustrated in FIG. 1.
Figure 3:
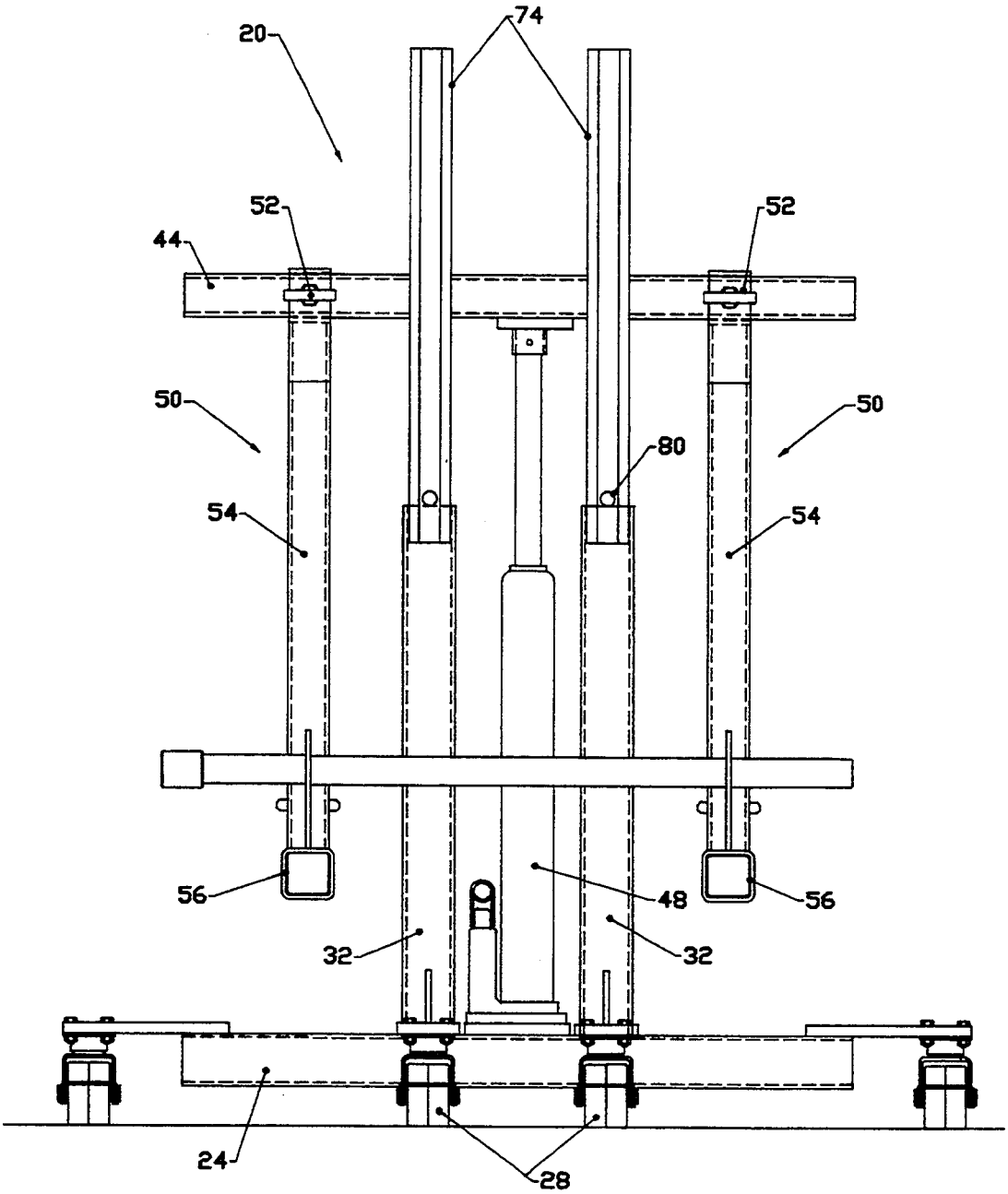
FIG. 3 is a front elevation view partially in section of the lifting apparatus illustrated in FIG. 1.
Figure 4:
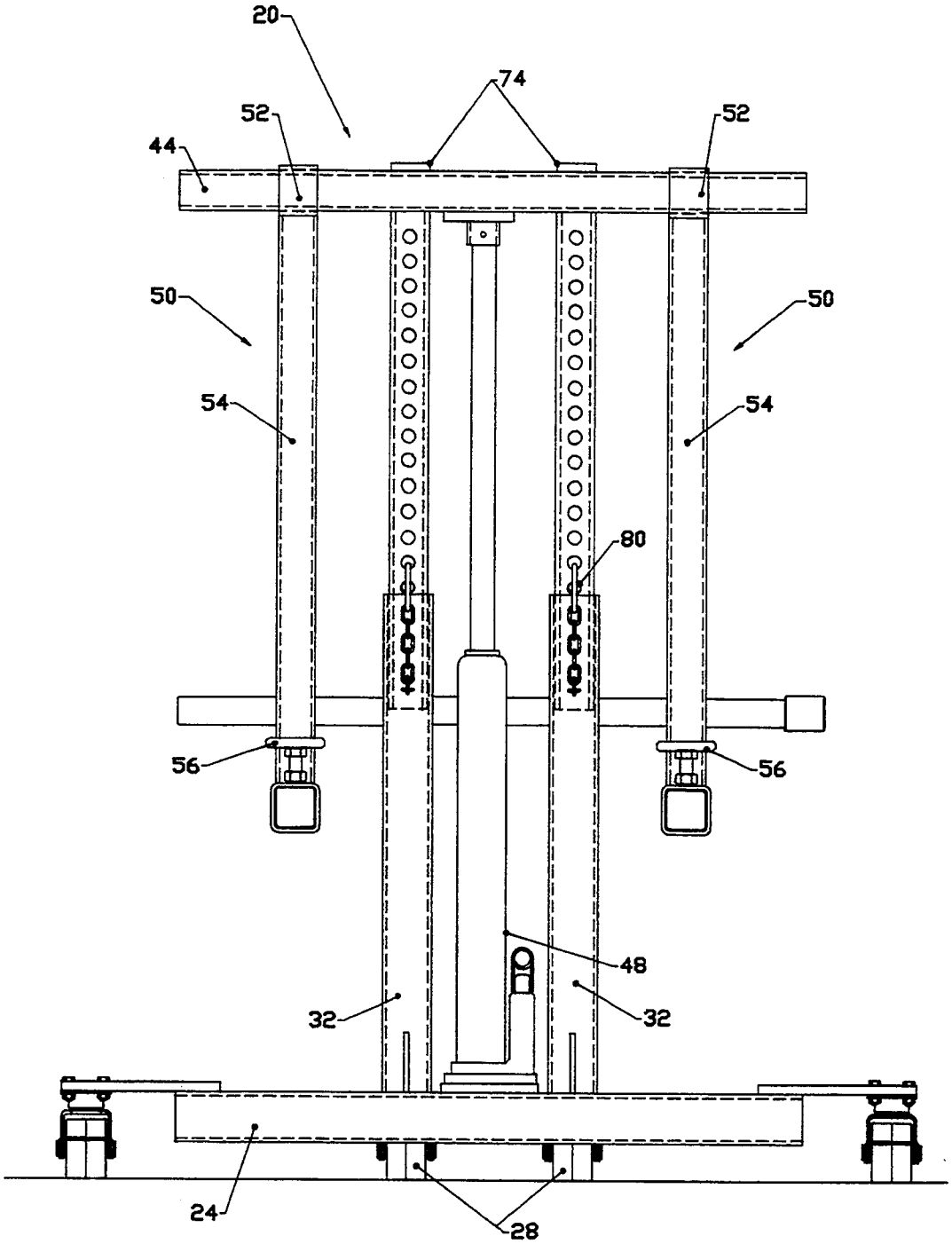
FIG. 4 is a rear elevation view partially in section of the lifting apparatus illustrated in FIG. 1.
Figure 5:
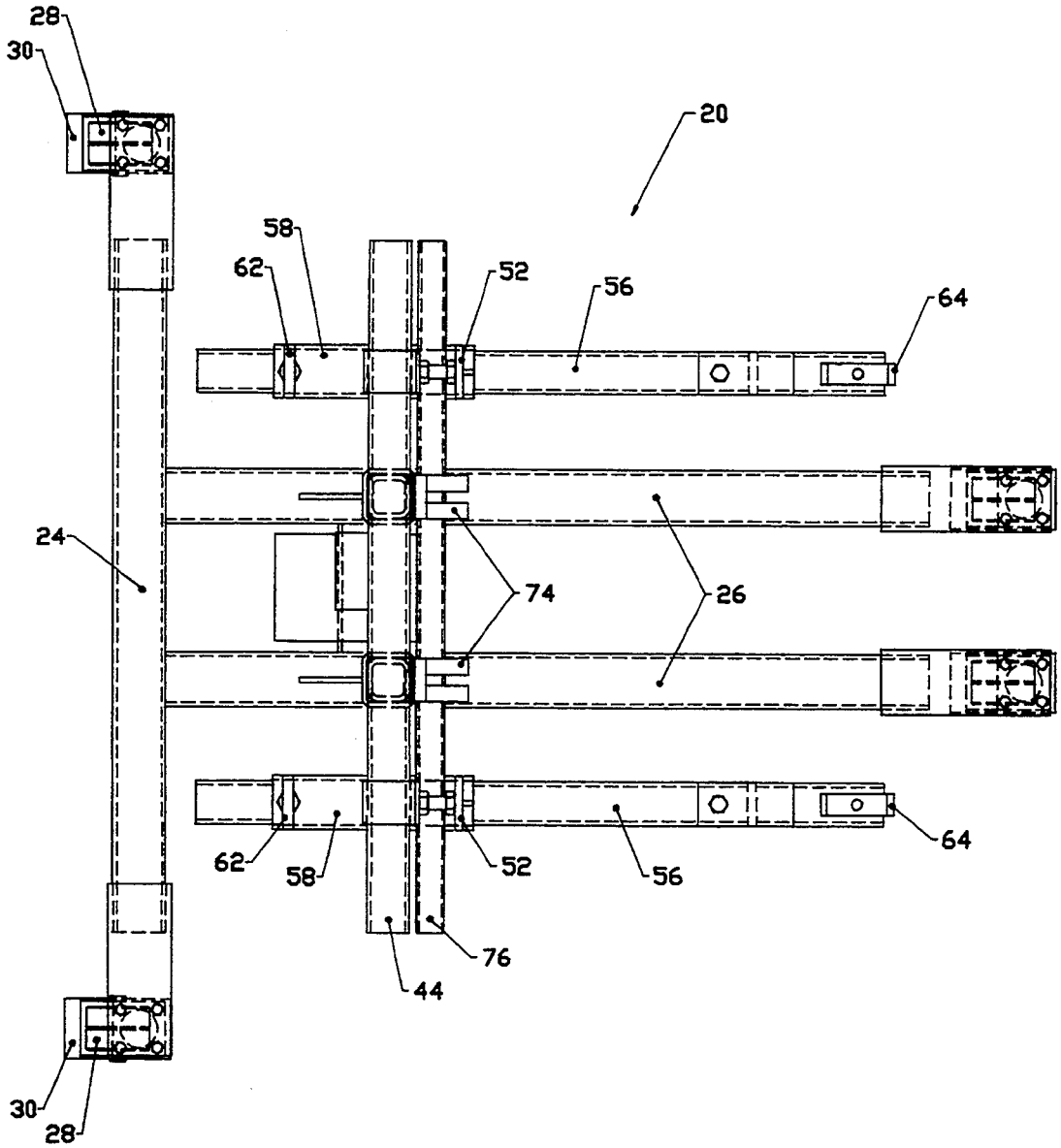
Figure 6:
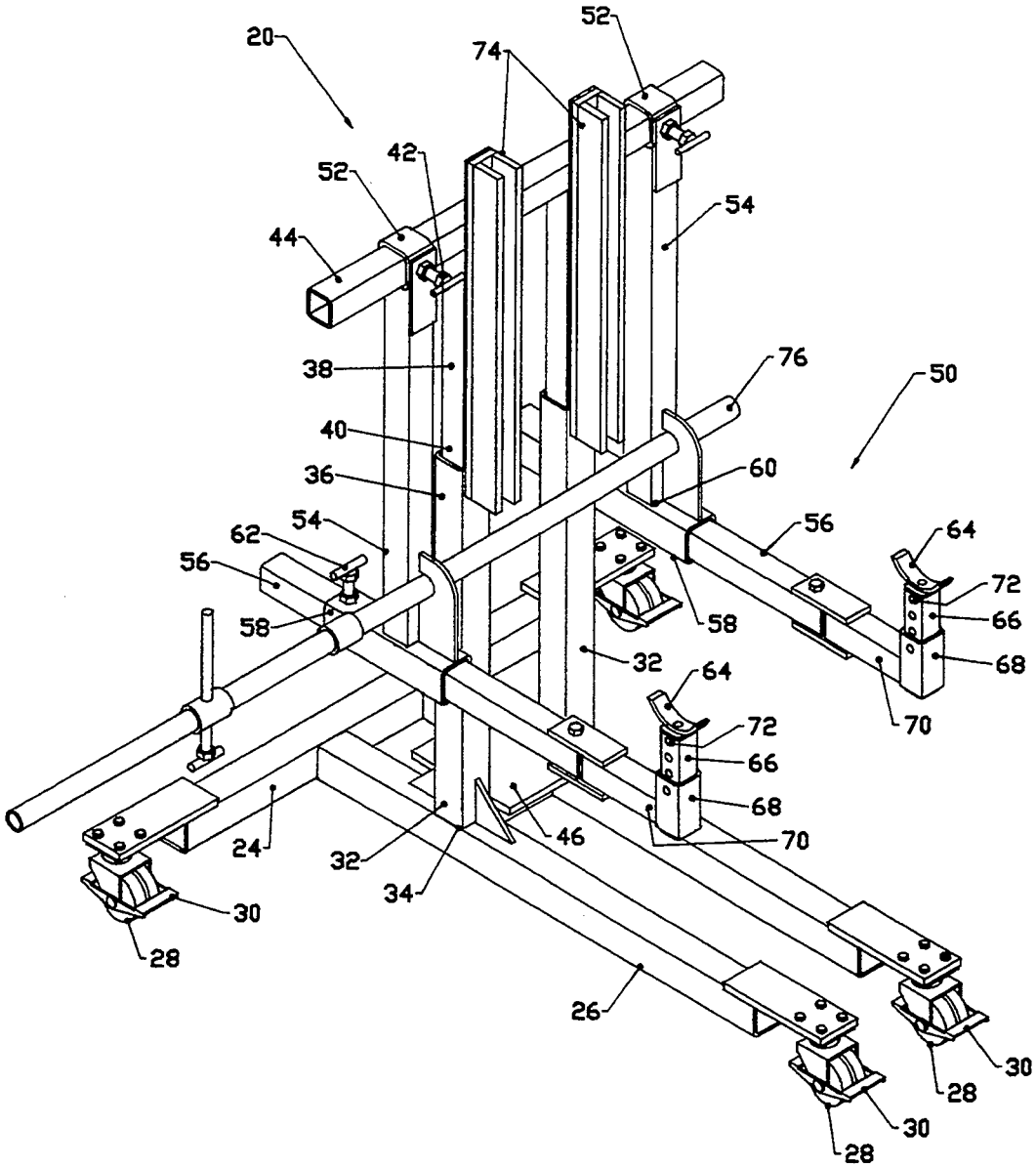
FIG. 6 is a perspective view of the lifting apparatus illustrated in FIG. 1, with vertical lifting point attachments.
Figure 7:
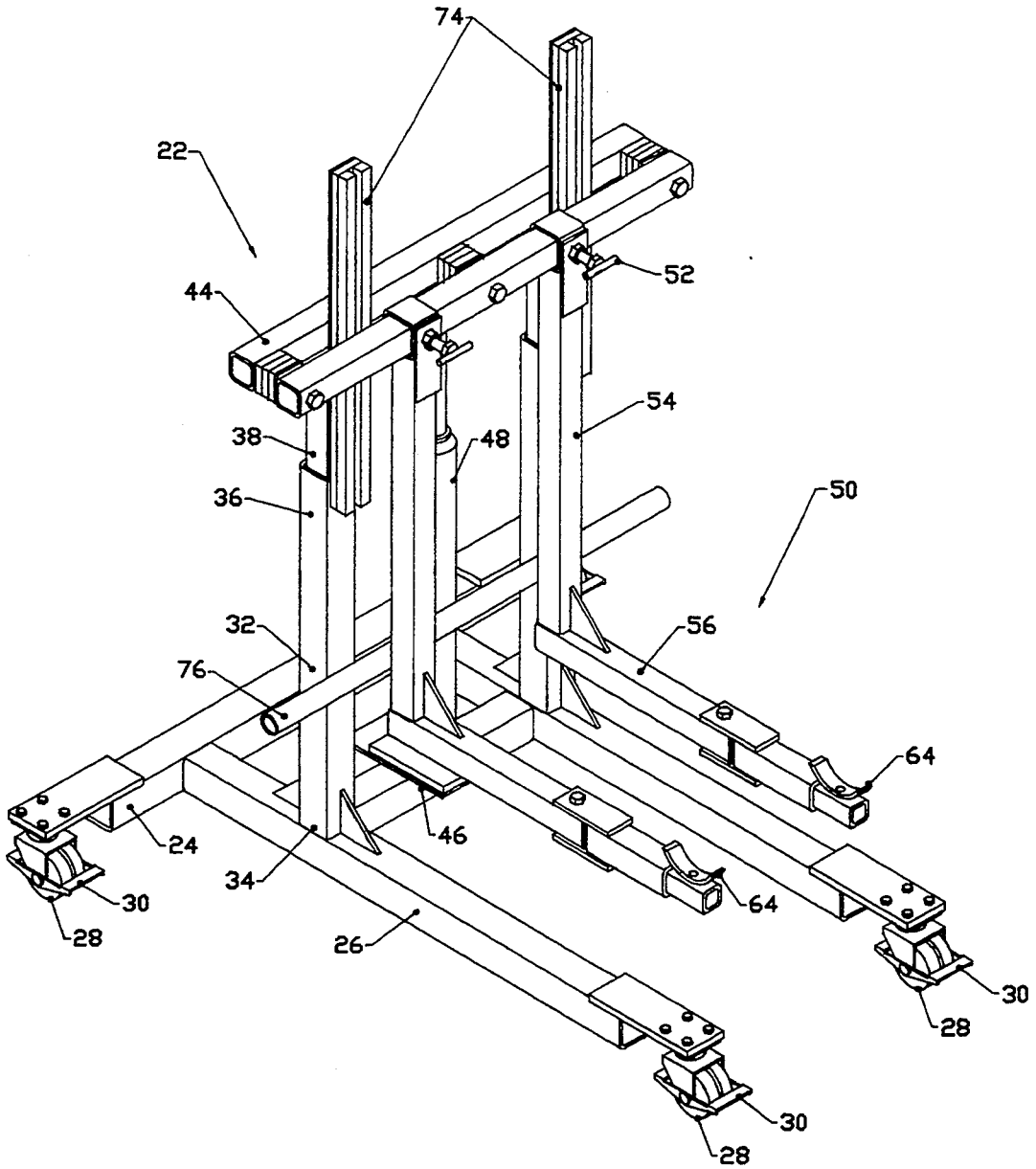
FIG. 7 is a perspective view of a second embodiment of a lifting apparatus constructed in accordance with the teachings of the present invention.
Figure 8:
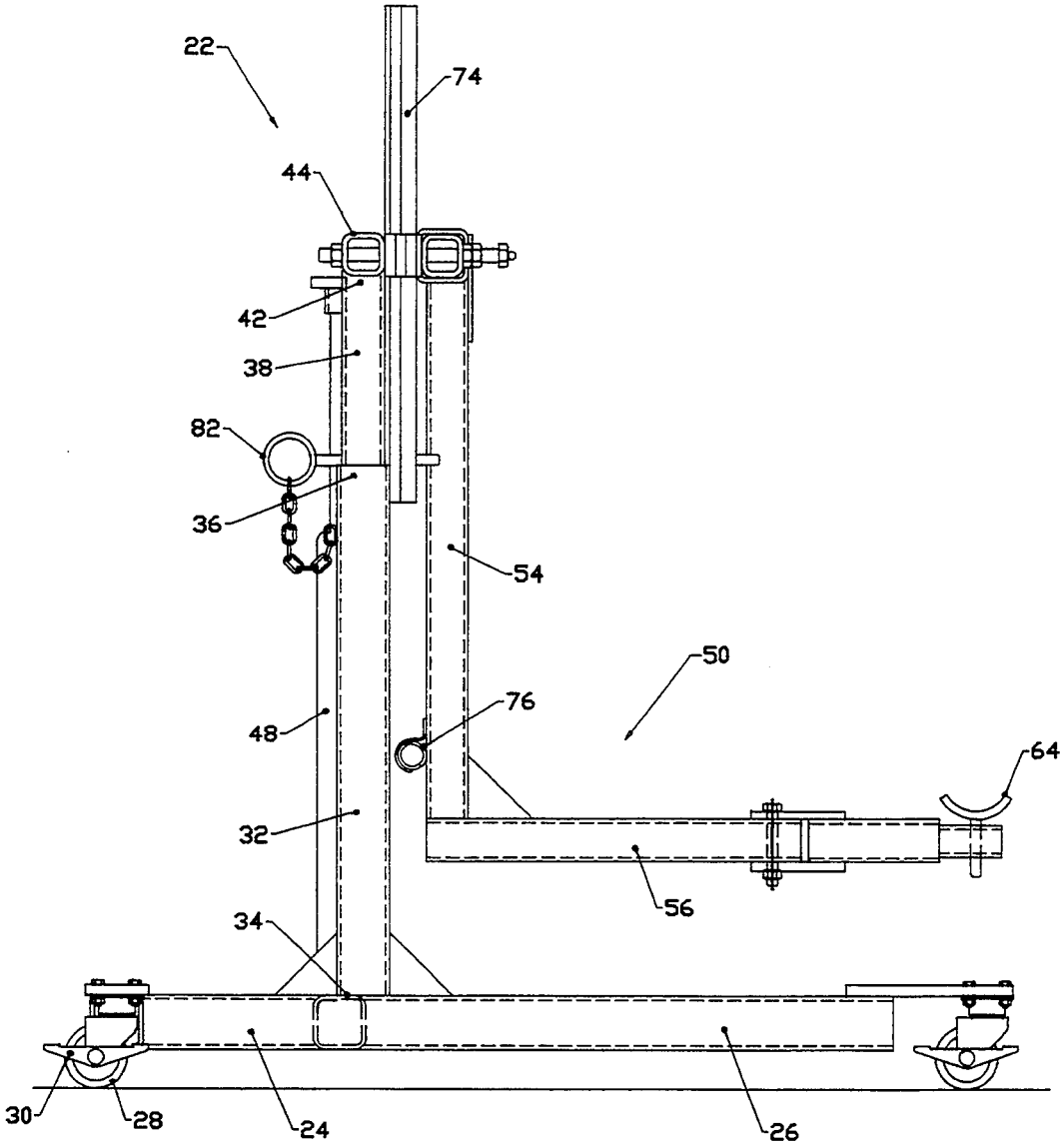
FIG. 8 is side elevation view of the lifting apparatus illustrated in FIG. 7.
Figure 9:
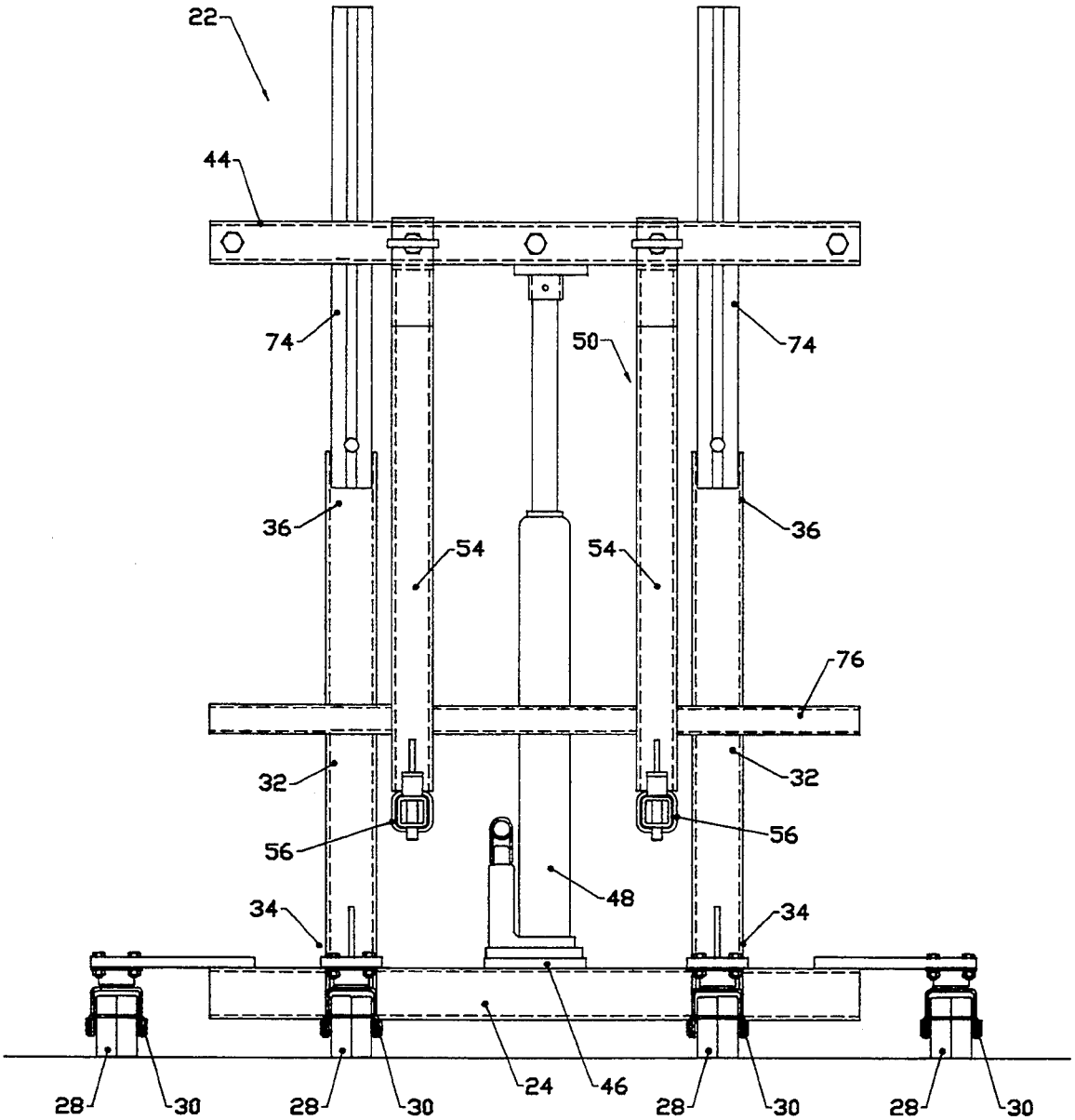
FIG. 9 is a front elevation view partially in section of the lifting apparatus illustrated in FIG. 7.
Figure 10:
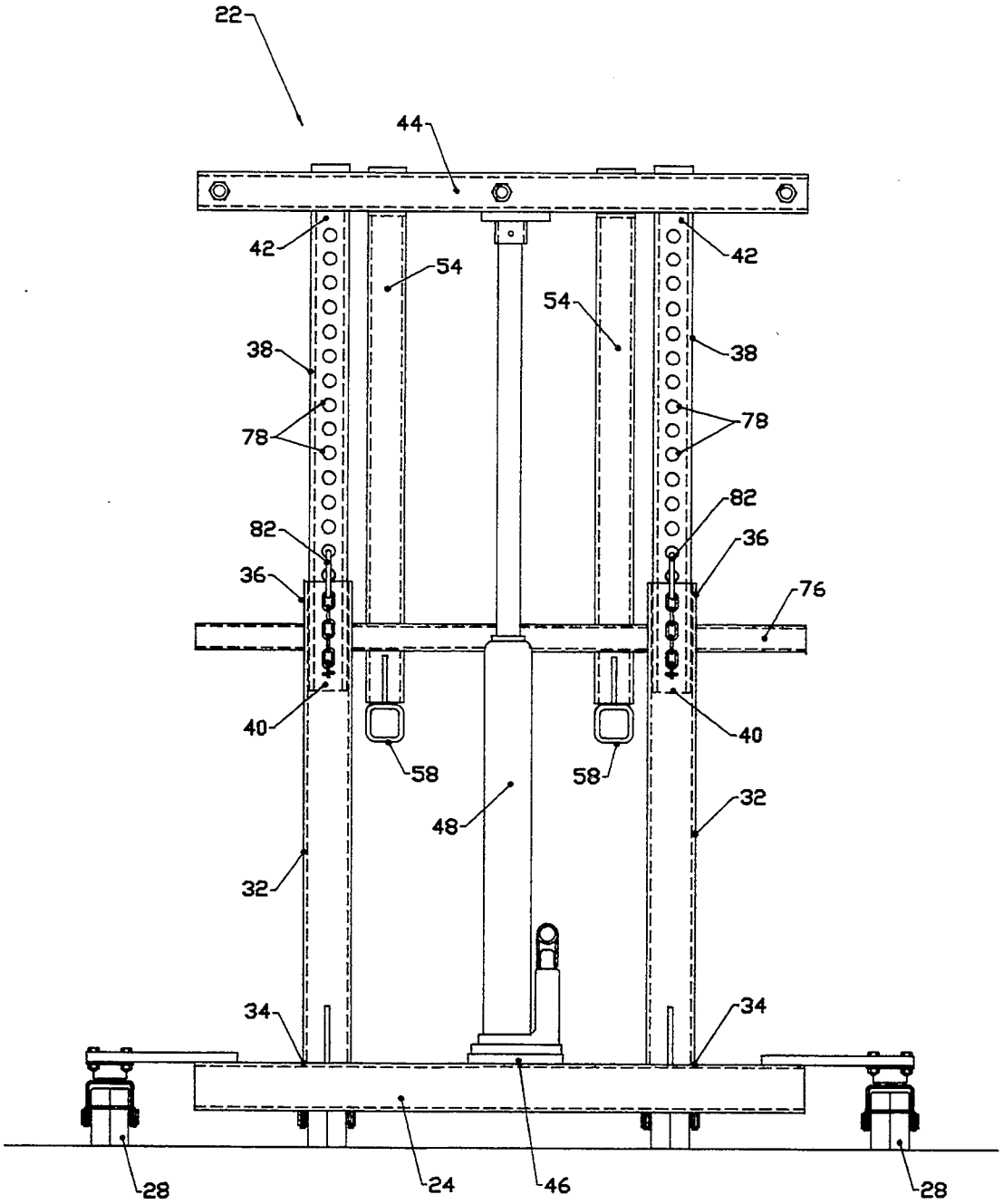
FIG. 10 is a rear elevation view of the lifting apparatus illustrated in FIG. 7.
Figure 11:
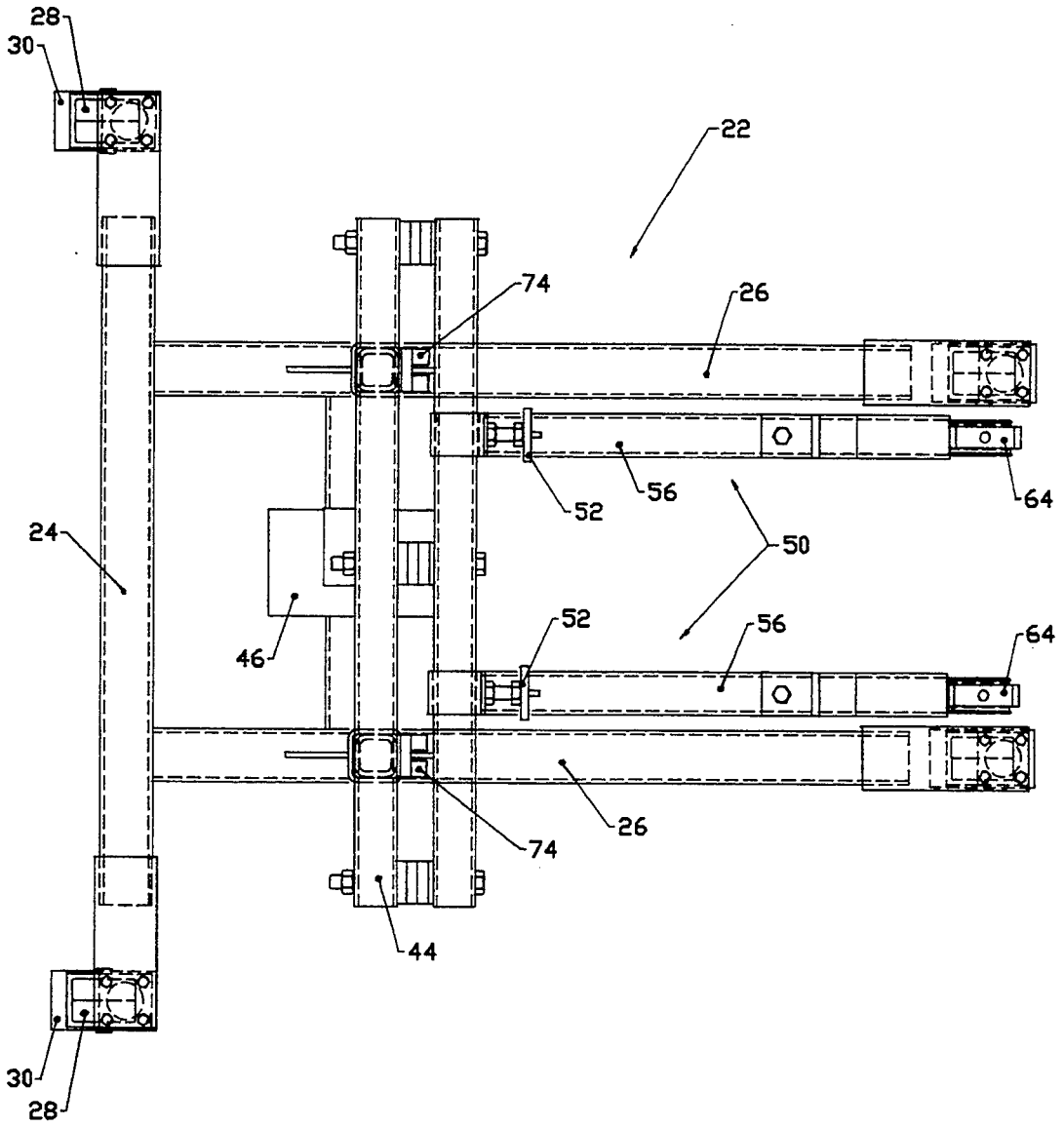
FIG. 11 is a top plan view of the lifting apparatus illustrated in FIG. 7.

Referring to FIGS. 1 through 13, lifting apparatus 20 and 22 both include a base 24 in the form of a frame with forwardly extending stabilizing legs 26. Base 24 is supported by rotatably mounted wheels 28 which have lever form locking mechanisms 30. Wheels 28 facilitate movement of base 24 throughout a working area. Locking mechanisms 30 permit wheels 28 to be non-rotatably locked in position when lifting apparatus 20 and 22 are in use. Two spaced apart tubular members 32 extend substantially vertically from base 24. Tubular members 32 have a first end 34 secured to base 24 and a second end 36. Two telescopic members 38 are provided having a first end 40 and a second end 42. First end 40 of telescopic members 38 is telescopically received in tubular members 32. A transverse member 44 is secured transversely between second end 42 of telescopic members 38. A jack positioning seat 46 is provided on base 24 vertically aligned with transverse member 44. A jack 48 placed on jack positioning seat 46 engages transverse member 44 to telescopically raise telescopic members 38. A pair of parallel spaced support arms 50 extend from transverse member 44. Support arms 50 are laterally movable along transverse member 44, whereby relative spacing of support arms 50 is adjusted. Clamps 52 are provided for locking support arms 50 in a preselected lateral position to transverse member 44. Support arms 50 are generally "L" shaped with a vertical portion 54 depending from transverse member 44 and a horizontal portion 56 extending horizontally from vertical portion 54. Referring to FIGS 1 and 2, vertical portion 54 on first embodiment 20 has a horizontal sleeve 58 at an end 60 remote from transverse member 44. Horizontal portion 56 is telescopically received in horizontal sleeve 58 thereby permitting horizontal portions 56 to be telescopically extended for desired positioning. A screw clamp 62 is provided for locking horizontal portion 56 in the preselected telescopic position. Horizontal portions 56 of each support arm 50 has cradle form lifting points 64 adapted for positioning under an object to be lifted (not shown). Referring to FIGS. 1 through 5, cradle form lifting points 64 are made detachable so that different forms of lifting points 64 may be substituted when the need arises. Referring to FIG. 6, lifting points 64 can be made in the form of lifting members 66 telescopically received in tubular cavities 68 at remote ends 70 of horizontal portions 56. Lifting members 66 are telescopically extendable from tubular cavities 68 to permit vertical adjustment of lifting points 64. Lifting members 66 and tubular cavities 68 have apertures 72 which when aligned with a pin (not shown) extending therethrough serve to lock lifting members 66 in a preselected telescopic position. It is important that base 24 remain stable when a load is placed upon lifting points 64 at remote ends 70 of horizontal portions 56. In the illustrated embodiments this is accomplished by having forwardly extending stabilizing legs 26 of base 24 extend past remote ends 70 of horizontal portions 56 of support arms 50. Stiffening support members 74 extend upwardly from tubular members 32 parallel to telescopic members 38 and on the same side of telescopic members 38 as support arms 50. These stiffening support members 74 provide lateral support to telescopic members 38 when a load is placed upon support arms 50. A roller 76 is mounted horizontally between vertical portions 54 of support arms 50. Roller 76 enables vertical portions 54 of support arms 50 to bear against tubular members 32 for lateral support when a load is placed upon lifting points 64. Referring to FIG. 4, telescopic meters 38 have a plurality of apertures 78 and stiffening support members 74 have one aperture 80. By aligning one of apertures 78 in telescopic members 38 with aperture 80 in stiffening support members 74 and inserting a pin 82 through aligned apertures 78 and 80 telescopic members 38 can be locked in a selected position relative to tubular members 32 when the object being lifted is at the desired height.

Figure 12:
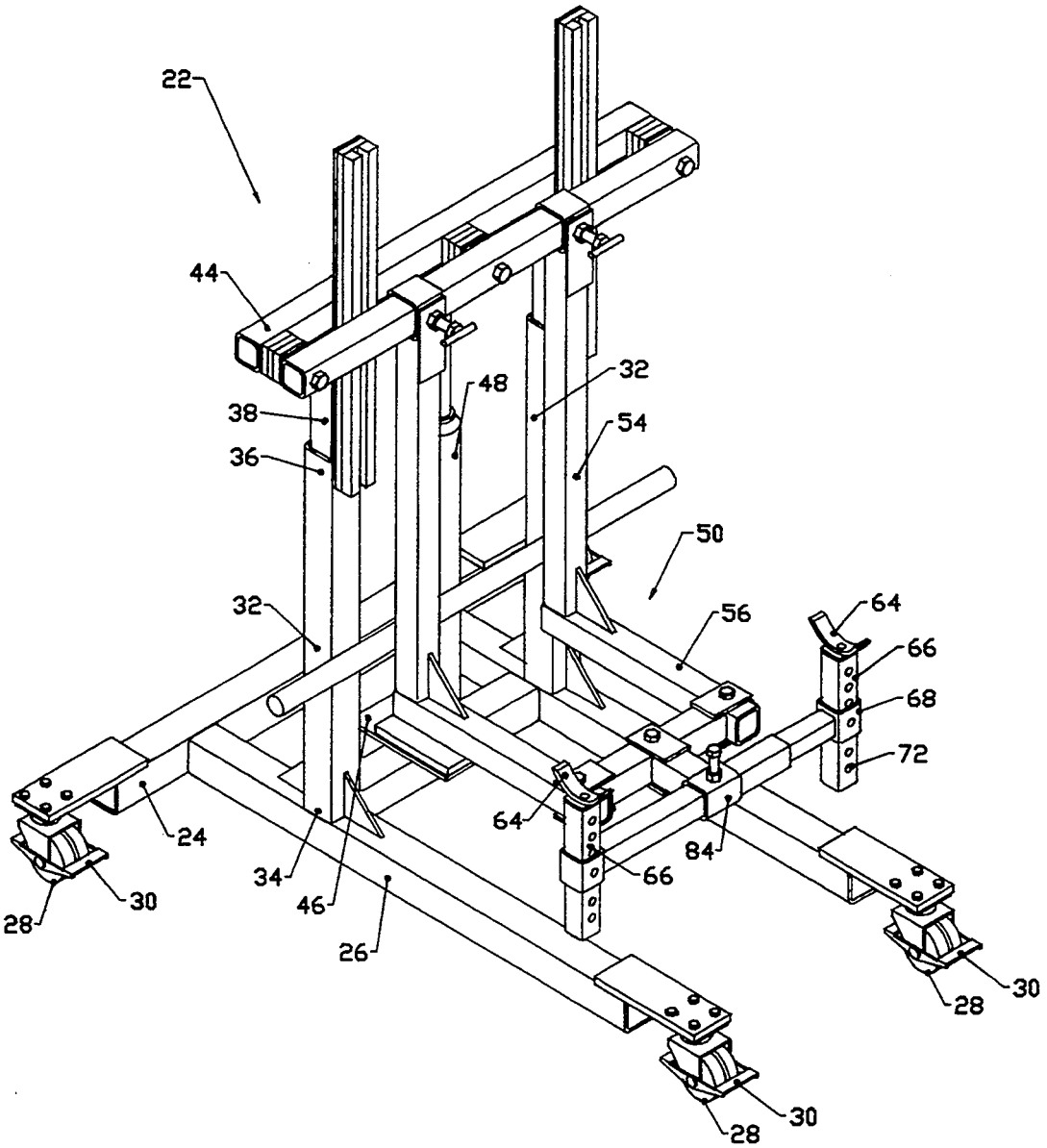
FIG. 12 is a perspective view of the lifting apparatus illustrated in FIG. 7, with vertical lifting point attachments.
Figure 13:
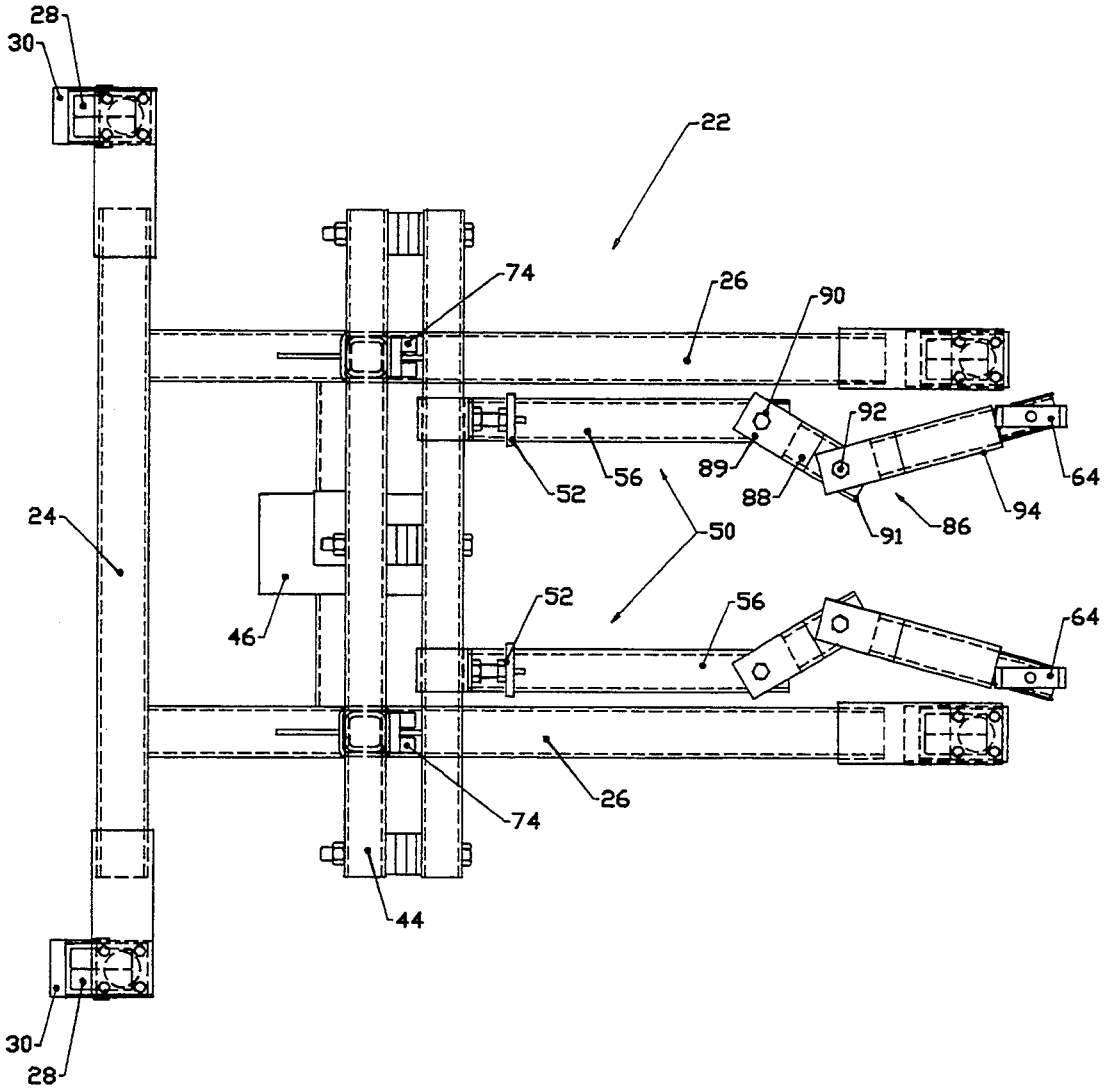
FIG. 13 is a top plan view of the lifting apparatus illustrated in FIG. 7, with horizontally adjustable lifting point attachments.

Every lifting apparatus must work within parameters dictated by its intended use. Those parameters usually relate to the spacing of the various components of the lifting apparatus. Second embodiment 22, as illustrated in FIGS. 7 through 13, provides a comparison with first embodiment 20, as illustrated in FIGS. 1 through 6, to demonstrate the design flexibility the present invention provides. The stance of stabilizing legs 26 on base 24 can be altered to meet space requirements. First embodiment 20 shows stabilizing legs 26 closely spaced, as compared to a spaced apart stance in second embodiment 22. The need for altering the lateral spacing of support arms 50 varies. First embodiment 20 shows support arms 50 positioned outside of tubular members 32. The ability to move support arms 50 together is limited as tubular members 32 get in the way. Second embodiment 22 shows an alternative form of transverse member 44. When this alternative form of transverse member 44 is used support arms 50 can be slid in front of tubular members 32 to a position where support arms 50 are immediately adjacent each other. In second embodiment 22, horizontal portion 56 of support arms 50 are not extendible, as the telescopic extension used in the first embodiment would interfere with lateral spacing of support arms 50. FIG. 12 illustrates a form of adaptor 84 that can be placed on second embodiment 22 to support lifting points 64. Adaptor 84 may be used as an alternative to the manner of supporting lifting points 64 illustrated in FIG. 6. More particularly, adaptor 84 is suited for use when the spacing of the operating components of the tractor precludes the use of lifting points 64 as illustrated in FIG. 6, for example where there is insufficient room to get both of support arms 50 into the working area under the tractor. FIG. 13 illustrates an pivot linkage, generally identified by reference numeral 86, which is used where there is insufficient room to get both of stabilizing legs 26 between the front tires of the tractor because the tractor has a small wheel base. Pivot linkage 86 consists of an intermediate link 88 having a first end 89 and a second end 91. Intermediate link 88 is pivotally attached at either end by pivot pins 90 and 92, respectively. Pivot pin 90 secures first end 89 of intermediate link 88 to horizontal portion 56 of support arms 50. Pivot pin 92 secures second end 91 of intermediate link 88 to a tubular extension 94 on which lifting points 64 are mounted. The use of pivot linkage 86 enables lifting points to extend past stabilizing legs 26. This should only be necessary with a small light weight tractor with a small wheel base. It would never be used with a large tractor as the weight of the tractor would create an unstable situation. It can be seen from a review of FIG. 13, the manner in which pivot linkage 86 can be manipulated to alter horizontal or lateral spacing of lifting points 64 to "reach around" components. It will be appreciated that pivot linkage 86 can be used on any of the illustrated embodiments.

It will be apparent to one skilled in the art that modifications may be made to the illustrated embodiments without departing from the spirit and scope of the invention as defined by the claims. In addition to the modifications illustrated in the alternative embodiments, it would be possible to use a different form of base 24 or even to stabilize base 24 by bolting it to the floor. There are, similarly, alternative configurations for support arms 50 that would perform the required function, they need not be "L" shaped.

The embodiments of the invention in which an exclusive property or privilege is claimed are defined as follows:

1. A lifting apparatus, comprising:

a. a base;

b. two paced apart tubular members extending substantially vertically from the base, the tubular members having a first end secured to the base and a second remote from the base;

c. two telescopic members telescopically received in the tubular members, the telescopic members being movable relative to the tubular members between extended and retracted positions;

d. a transverse member secured transversely between the telescopic members;

e. a jack positioning seat on the base vertically aligned with the transverse member, such that a jack placed on the jack positioning seat engages the transverse member to telescopically raise telescopic members;

f. a pair of substantially parallel spaced support arms extending from the transverse member, each support arm having lifting points adapted for positioning under an object to be lifted the base being adapted to maintain stability when a load is placed on the lifting points of the support arms;

g. stiffening support members extending upwardly from the second end of the tubular members parallel to the positioning of the telescopic members when in an extended position and on the same side of the telescopic members as the support arms such that the stiffening support members provide lateral support to the telescopic members when a load is placed upon the support arms; and g. means for locking the telescopic members in a selected position relative to the tubular members when the object being lifted is a the desired height.

2. The lifting apparatus as defined in claim 1, the base being in the form of a frame having stabilizing legs that extend past the support arms thereby providing stability to the base when a load is placed on the lifting points of the support arms.

3. The lifting apparatus as defined in claim 1, the support arms being generally "L" shaped with a vertical portion depending from the transverse member and a horizontal portion extending from the vertical portion, the lifting points being on the horizontal portions, the support arms being laterally movable along the transverse member, whereby relative spacing the support arms is adjusted.

4. The lifting apparatus as defined in claim 3, the lifting points being vertically adjustable.

5. The lifting apparatus as defined in claim 3, a roller mounted horizontally and extending between the vertical portions the support arms, the roller engaging the vertical portions of the support arms and the tubular members whereby the vertical portions of the support arms receive lateral support from the tubular members when a load is placed upon the lifting points of the support arms.

6. The lifting apparatus as defined in claim 3, the horizontal portion of the support arms being telescopically extendable.

7. The lifting apparatus as defined in claim 1, the means for locking the telescopic members in a selected position relative to the tubular members being a plurality of apertures in the telescopic members one of which is aligned with an aperture in the stiffening support members, a pin being inserted through the aligned apertures thereby locking the telescopic members in a selected position relative to the tubular members.

8. The lifting apparatus as defined in claim 1, a pivot linkage being disposed between the lifting points and the support arms such that the lateral spacing of the lifting points is adjustable, the pivot linkage including an intermediate link having a first end and a second end, the first end being pivotally attached to the support arms, the second end being pivotally attached to a tubular extension on which the lifting points are mounted.

9. A lifting apparatus, comprising:

a. a base in the form of a frame having stabilizing legs;

b. two spaced apart tubular members extending substantially vertically from the base;
c. two telescopic members telescopically received in the tubular members;
d. a transverse member secured transversely between the telescopic members;
e. a jack positioning seat on the base vertically aligned with the transverse member, such that a jack placed on the jack positioning seat engages the transverse meter to telescopically raise telescopic members;
f. a pair of parallel spaced support arms extending from the transverse member, the support arms being laterally movable along the transverse member, whereby relative spacing the support arms is adjusted, the support arms being generally "L" shaped with a vertical portion depending from the transverse member and a horizontal portion extending from the vertical portion, the horizontal portions of each support arm having lifting points adapted for positioning under an object to be lifted, the horizontal portion of the support arms being telescopically extendable, the stabilizing legs of the base extending past the support arms thereby providing stability to the base when a load is placed on the lifting points of the support arms;
g. stiffening support members extending upwardly from the tubular members parallel to the telescopic members and on the same side of the telescopic members as the support arms such that the stiffening support members provide lateral support to the telescopic members when a load is placed upon the support arms;
h. a roller mounted horizontally between the vertical portions of the support arms thereby facilitating the vertical portions of the support arms bearing against the tubular members for lateral support when a load is placed upon the lifting points of the support arms; and
i. means for locking the telescopic members in a selected position relative to the tubular members when the object being lifted is at the desired height.

10. The lifting apparatus as defined in claim 8, the lifting points being vertically adjustable.

11. The lifting apparatus as defined in claim 8, the means for locking the telescopic members in a selected position relative to the tubular members being a plurality of apertures in the telescopic members one of which is aligned with an aperture in the stiffening support members, a pin being inserted through the aligned apertures thereby locking the telescopic members in a selected position relative to the tubular members.

12. A lifting apparatus, comprising:
a. a base in the form of a frame having stabilizing legs;
b. two spaced apart tubular members extending substantially vertically from the base;
c. two telescopic members telescopically received in the tubular members;
d. a transverse member secured transversely between the telescopic members;
e. a jack positioning seat on the base vertically aligned with the transverse member, such that a jack placed on the jack positioning seat engages the transverse member to telescopically raise telescopic members;
f. a pair of parallel spaced support arms extending from the transverse member, the support arms being laterally movable along the transverse member, whereby relative spacing the support arms is adjusted, the support arms being generally "L" shaped with a vertical portion depending from the transverse member and a horizontal portion extending from the vertical portion, the horizontal portions of each support arm having lifting points adapted for positioning under an object to be lifted, the horizontal portion of the support arms being telescopically extendable, the lifting points being vertically adjustable, the stabilizing legs of the base extending past the support arms thereby providing stability to the base when a load is placed on the lifting points of the support arms;
g. stiffening support members extending upwardly from the tubular members parallel to the telescopic members and on the same side of the telescopic members as the support arms such that the stiffening support members provide lateral support to the telescopic members when a load is placed upon the support arms;
h. a roller mounted horizontally between the vertical portions of the support arms thereby facilitating the vertical portions of the support arms bearing against the tubular members for lateral support when a load is placed upon the lifting points of the support arms; and
i. a plurality of apertures in the telescopic members and an aperture in the stiffening support members, one of the apertures in the telescopic members being aligned with the aperture in the stiffening support members and a pin being inserted through the aligned apertures thereby locking the telescopic members in a selected position relative to the tubular members when the object being lifted is at the desired height.

13. A lifting apparatus, comprising:
a. a base in the form of a frame including forwardly extending stabilizing legs, the base being supported by rotatably mounted wheels having locking mechanisms;
b. two spaced apart tubular members extending substantially vertically from the base;
c. two telescopic members telescopically received in the tubular members;
d. a transverse member secured transversely between the telescopic members;
e. a jack positioning seat on the base vertically aligned with the transverse member, such that a jack placed on the jack positioning seat engages the transverse member to telescopically raise telescopic members;
f. a pair of parallel spaced support arms extending from the transverse member, the support arms being laterally movable along the transverse member, whereby relative spacing the support arms is adjusted, clamps locking the support arms in a preselected position to the transverse member, the support arms being generally "L" shaped with a vertical portion depending from the transverse member and a horizontal portion extending from the vertical portion, the horizontal portions of each support arm having lifting points adapted for positioning under an object to be lifted, the horizontal portion of the support arms being telescopically extendable, clamps locking the horizontal portion of the support arms in a preselected telescopic position, the lifting points being in the form of cradle form lifting members being telescopically received in tubular cavities at remote ends of the horizontal portions whereby the lifting points are vertically adjustable, the lifting members and the tubular cavities having apertures which when aligned with a pin extending therethrough serve to lock the lifting members in a preselected telescopic position, the forwardly extending stabilizing legs of the base extending past the remote ends of the support arms thereby providing stability to the base when a load is placed on the lifting points of the support arms;

g. stiffening support members extending upwardly from the tubular members parallel to the telescopic members and on the same side of the telescopic members as the support arms such that the stiffening support members provide lateral support to the telescopic members when a load is placed upon the support arms;

h. a roller mounted horizontally between the vertical portions of the support arms thereby facilitating the vertical portions of the support arms bearing against the tubular members for lateral support when a load is placed upon the lifting points of the support arms; and i. a plurality of apertures in the telescopic members and an aperture in the stiffening support members, one of the apertures in the telescopic members being aligned with the aperture in the stiffening support members and a pin being inserted through the aligned apertures thereby locking the telescopic members in a selected position relative to the tubular members when the object being lifted is at the desired height.

* * * * *